US005206563A

United States Patent [19]

Castelli

[11] Patent Number: 5,206,563

[45] Date of Patent: Apr. 27, 1993

[54] LIGHTBULB LIFE EXTENDER

[75] Inventor: Anthony B. Castelli, Grubville, Mo.

[73] Assignee: Harold W. Glacken, Jr., Dittmer, Mo. ; a part interest

[21] Appl. No.: 866,799

[22] Filed: Apr. 8, 1992

[51] Int. Cl.[5] ..... H05B 39/00; H01R 13/713; H01R 13/73

[52] U.S. Cl. ..... 315/127; 315/200 R; 340/656; 363/146

[58] Field of Search ..... 315/127, 185 S, 200 R, 315/313, 362; 363/146; 340/656

[56] References Cited

U.S. PATENT DOCUMENTS

| | | | |
|---|---|---|---|
| 2,028,191 | 1/1936 | Chereton | 363/146 |
| 3,331,013 | 7/1967 | Cunningham | 323/239 |
| 3,823,339 | 7/1974 | Borneman et al. | 315/69 |
| 4,117,376 | 9/1978 | Andrews | 315/362 X |
| 4,438,344 | 3/1984 | Albert et al. | 307/146 |
| 4,473,776 | 9/1984 | Peters | 315/74 |
| 4,480,212 | 10/1984 | Monahan et al. | 315/71 |
| 4,547,704 | 10/1985 | Brinn et al. | 315/71 |
| 4,701,676 | 10/1987 | Gibson | 315/362 |
| 4,888,678 | 12/1989 | Sundhar | 363/146 |
| 4,897,578 | 1/1990 | Goad, Sr. | 315/71 |
| 4,922,155 | 5/1990 | Morris et al. | 315/205 |

*Primary Examiner*—David Mis
*Attorney, Agent, or Firm*—Robbins & Robbins

[57] ABSTRACT

An electrical device is provided for converting alternating current to direct current for an incandescent lightbulb circuit to extend the life of the bulb and reduce power consumption. The device provides a housing containing a diode rectifier adapted to be electrically connected to an alternating current source of supply and the incandescent lightbulb circuit. A resettable circuit breaker is employed to break the circuit when overloaded with an external resettable switch. The housing may further be provided with a low silhouette and a plug in order that the device may simply be plugged into an electrical wall receptacle. For ease of connection to the incandescent lightbulb circuit, an electrical receptacle may be provided on the exterior of the housing to receive a plug from the lightbulb circuit.

6 Claims, 1 Drawing Sheet

LIGHTBULB LIFE EXTENDER

BACKGROUND OF THE INVENTION

In the past various devices have been provided to convert an alternating current to direct current supplied to an incandescent lightbulb to reduce power consumption and lengthen the life of the lightbulb with attendant cost saving. Such devices have commonly been employed in the lightbulb socket or incorporated into the structure of the lightbulb.

In addition, some circuits have been provided with rectifying diodes and fuse to prevent damage to overload. Such circuits have required replacement of fuses and are inconvenient.

It has remained a problem to provide a device which can be simply employed with a conventional alternating current source to supply direct current to an incandescent lightbulb circuit which is transportable to other circuits and has provisions for protecting against overloads with easy resetting of the device should the overload cause the circuit to be opened.

SUMMARY OF THE INVENTION

By means of this invention there has been provided an electrical device which may be simply employed with various alternating current power supply sources to provide direct current to an incandescent lightbulb circuit to save electrical energy and extend the life of the incandescent bulb.

The device is comprised of a housing containing a diode rectifier for converting an alternating current input to a direct current output which may be connected to an electrical circuit for one or more incandescent lightbulbs. In order to protect against current overload and consequent damage, a re-settable circuit breaker is connected to the electrical circuit. A re-settable switch externally mounted on the housing ensures easy access and convenience in the operation of the system.

The housing is small in size and may be transported to any area having an electrical source of supply such as wall receptacles, extension cords or the like. In particular, the housing may be constructed in a small box-like form with a somewhat flat low silhouette in order that an electric plug fixed to the bottom of the housing may be plugged into an electric wall receptacle.

Further, adding to the convenience in use and adaptability is the employment of one or more electric receptacles for receiving plugs of an incandescent lightbulb circuit such as lamp cord plug or other similar circuits. The receptacles may be set into the top or sides of the housing as desired.

The electrical converting device of the invention may be simply employed in any area of a residential, industrial or commercial building servicing an incandescent lightbulb circuit exclusively. The device is rugged in construction and may be used simply to provide a saving in electrical energy and to extend the life of the lightbulbs served.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
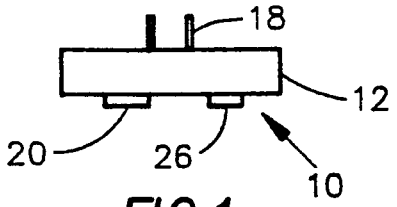
FIG. 1 is a view in front side elevation of the electrical device of this invention.
Figure 2:
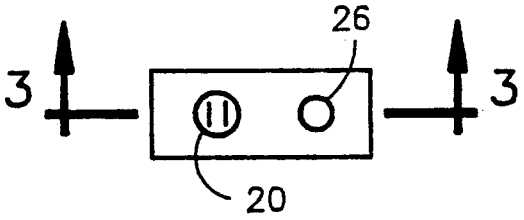
FIG. 2 is a top plan view of the device.
Figure 3:
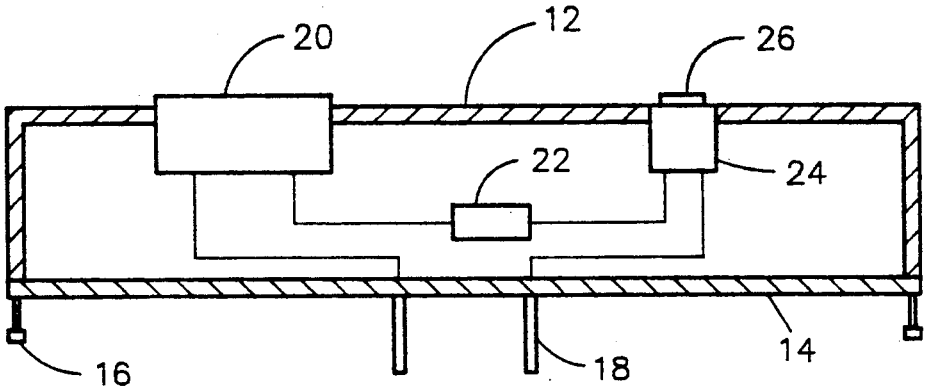
FIG. 3 is a view in vertical section taken on line 3—3 of FIG. 2.
Figure 4:
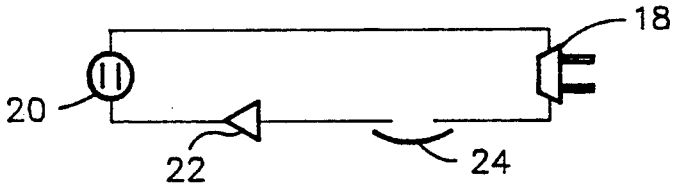
FIG. 4 is an electrical wiring diagram of the electrical circuit of the device.

The electrical device of this invention is generally indicated by the reference numeral 10 in FIGS. 1, 2 and 3. It is comprised of a box-like low silhouette housing 12 containing and supporting the electrical components. The housing is constructed of a suitable rigid material. Plastic is particularly suitable in view of the capacity to be molded in a convenient form and for its insulating ability.

The housing is of an open nature to provide accessibility for any necessary inspection or repair. It has a removable bottom cover 14 which may be screwed to the housing by screws 16.

In order to provide for an input of electrical energy, a two prong plug 18 is fixed to the bottom of the cover 14. It will be understood that the plug may be fixed at the side of the housing and may be swivelled as desired. By this relation, the entire device may be simply plugged into a wall socket or receptacle to provide 120 volt alternating current to the device. The two prong plug is of conventional structure and is firmly fixed to the cover in order that when plugged into an receptacle, the entire housing is firmly supported against a standard wall supported receptacle to provide an unobstructive low silhouette structure. It will be understood that where desired, the plug may be connected to a conventional two wire conductor, such as a short pigtail, leading into the components within the housing.

The housing is further provided with an electrical output receptacle 20 which may be connected to a conventional incandescent lightbulb circuit (not shown). This receptacle is of conventional construction which receives a conventional two prong plug connected to conductors for the lightbulb circuit.

The internal components of the electrical device supported within the housing comprise a rectifier diode 22 and a resettable circuit breaker 24 having a resettable button 26. The rectifier diode is of standard construction and may be, for example, 3 amperes. The circuit breaker and resettable button are likewise of standard construction made in a single package unit and for example may have a value of 2.5 amperes set to break at 300 watts.

Figure 5:
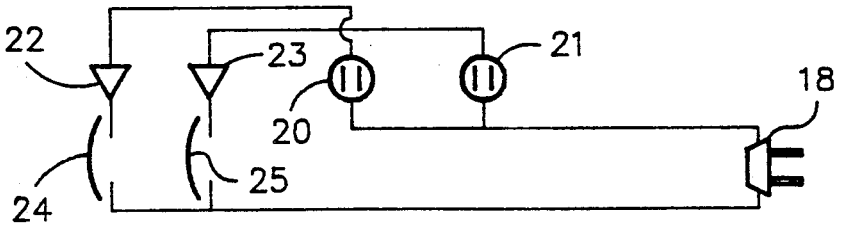
FIG. 5 is a view similar to FIG. 4 showing a modified multiple receptacle, diode and circuit breaker wiring diagram.

FIG. 5 shows a modification in which multiple receptacle outlets 20 ad 21 may be employed with multiple diode rectifiers 22 and 23 and multiple circuit breakers 24 and 25. This provides for reception of separate incandescent light circuits, such as separate lamps or the like.

USE

The device in use may be plugged into a conventional 120 volt alternating current receptacle or socket. The diode rectifier will reduce the output voltage to the receptacle 20 to 56 volts direct current. The brilliance or luminosity of the standard incandescent lightbulb of 25 watts to 300 watts will be comparable to that obtained using a standard 120 volt alternating current without the device of the invention.

The expected life of the bulb should be four to six years or 17,280 to 25,920 hours of life usage. The heat of the bulb will also be reduced by about 45% and energy consumption by about 50%.

The electrical device should be used with incandescent lightbulbs only. Wattage should not exceed 300 watts when the bulbs are used singly or in multiple for the circuit parameters described herein.

The housing and plug 18 provide a simple plug-in device that can be installed rapidly and efficiently in a wall outlet or the like. The low silhouette is unobstrusive and simplifies a snug connection to a wall surface. The single receptacle circuit of FIGS. 1–4 or the multiple circuit of FIG. 5 serve to furnish the rectifier to one or a plurality of lamp circuits. Should for any reason there be a momentary surge of electricity, the circuit breaker ensures that the circuit is broken. When the surge source has subsided or been located and removed, the reset button 26 is simply re-set to re-establish the circuit.

Various changes and modifications may be made within this invention as will be apparent to those skilled in the art. Such changes and modifications are within the scope and teaching of this invention as defined in the claims appended hereto.

What is claimed is:

1. An electrical device for providing direct current to incandescent lightbulbs, said device comprising a housing, an electrical circuit contained within said housing comprising a diode rectifier having circuit means for connection to an alternating current source, circuit means connecting a direct current output from said diode to a circuit supplying said direct current to an incandescent lightbulb circuit and a circuit breaker connected to said diode, said circuit breaker having a resettable switch externally mounted on said housing.

2. The electrical device of claim 1 in which said housing is provided with an externally mounted receptacle for receiving an electrical plug connected to said incandescent lightbulb circuit.

3. The electrical device of claim 1 in which said housing is provided with a plug electrically connected to said diode and fixedly mounted in supporting relation to said housing.

4. The electrical device of claim 3 in which said housing is a box having a shallow height and a flat bottom to which said plug is secured to enable the housing to be plugged into a wall mounted receptacle to provide a low shallow silhouette.

5. The electrical device of claim 1 in which said housing is provided with an externally mounted receptacle for receiving an electrical plug connected to said incandescent lightbulb circuit and said housing is provided with a plug electrically connected to said diode and fixedly mounted in supporting relation to said housing.

6. The electrical device of claim 5 in which said housing is a box having a shallow height and a flat bottom to which said plug is secured to enable the housing to be plugged into a wall mounted receptacle to provide a low shallow silhouette.

* * * * *